US005464213A

United States Patent [19]

Lee et al.

[11] Patent Number: 5,464,213

[45] Date of Patent: Nov. 7, 1995

[54] ARCADE TYPE OF PINBALL TOY

[75] Inventors: James S. W. Lee, Long Island, N.Y.; Chiu K. Kwan, Hunghom, Hong Kong

[73] Assignee: C.J. Associates, Ltd., Hunghom, Hong Kong

[21] Appl. No.: 201,547

[22] Filed: Feb. 25, 1994

[51] Int. Cl.[6] ..... A63F 7/22

[52] U.S. Cl. ..... 273/121 A; 118 A/119 A

[58] Field of Search ..... 273/118 R, 108, 273/118 A, 119 R, 121 A, 121 E; 446/219; 472/63, 50

[56] References Cited

U.S. PATENT DOCUMENTS

| | | | |
|---|---|---|---|
| 2,866,275 | 12/1958 | Reynolds | 273/118 A |
| 5,292,127 | 3/1994 | Kelly et al. | 273/118 R |
| 5,316,303 | 5/1994 | Trudeau et al. | 273/118 A |

FOREIGN PATENT DOCUMENTS

| | | | |
|---|---|---|---|
| 2440209 | 7/1980 | France | 273/118 A |

*Primary Examiner*—Vincent Millin
*Assistant Examiner*—Charles W. Anderson
*Attorney, Agent, or Firm*—Laff, Whitesel, Conte & Saret, Ltd.

[57] ABSTRACT

A toy simulates an arcade game. A compartment at the top of a box has a transparent bottom and contains game pieces that may be manipulated from a control panel at a front of a box. A mirror in the box reflects the image of the game pieces as seen through the transparent bottom. To play the game, a user looks at the reflection image of the game pieces while he manipulates the controls at the front of the box. Here, the game is a pinball machine in which the transparent bottom has a plurality of upstanding pegs which divert balls into random paths. Any balls which are caught by a manipulation of the controls are diverted into one scoring path. Any balls which are not so caught fall into another scoring path. The invention provides for releasing a selected number of objects at one time to change the required skill level to play. Also, by changing the direction in which the transparent bottom slants, different games maybe provided.

23 Claims, 2 Drawing Sheets

ARCADE TYPE OF PINBALL TOY

This invention relates to toys and more particularly to toys simulating arcade types of games, especially pinball games for use in a family environment.

Generally, arcade games are fairly large, heavy, and expensive machines which permit a person to manipulate controls in order to accumulate a score, compete with other players, and the like. Examples of such arcade games are pinball machines, pachinko, computerized simulations of war games, and sports events, for example.

These machines are found in public rooms, restaurants, or the like, primarily because they are too expensive and occupy too much space for the average home. Nevertheless, people would like to have them in a convenient environment, such as the home, for family entertainment. This is especially true when children are involved. The children want to play games that are similar to games that they have seen adults play. Their parents want to know where they are and to be sure that they are out of harm's and temptation's way.

To fill this need, a toy simulating an arcade game machine should sell at a very low cost, should be light enough to carry easily, and should not occupy too much space. The game should be easy enough for a child to play and to become an accomplished player. Still, it should be challenging enough for a youth, parents, or adults to find of interest, especially when they are playing with their children. It should feature new and novel play which has not been available heretofore. From the manufacturer's view point, such a toy should offer an opportunity to manufacture a large number of different toys, using the same principles.

Accordingly, an object of the invention is to provide new and novel toys and games of the described type. In this connection, an object is to provide a form of game toy which may be made in a great variety of different ways. In this connection, an object is to provide both simple games, which a child can play, and more complex games, as by requiring a higher level of hand and eye coordination.

In keeping with an aspect of this invention, these and other objects are accomplished by providing a box which is open on one Side. The inside under surface at the top of the box is a transparent panel positioned so that game pieces may move over it in a predictable manner, perhaps sliding under gravity, perhaps driven by an electric motor.

For example, balls released at one edge of the transparent panel may roll over it to the opposite edge. The player may divert or catch the rolling balls in order to play the game. The background above the transparent panel may include any graphics or objects appropriate to the game. A mirror is set in the box, at an angle facing the open side of the box in order to reflect the transparent panel to the player. The playing pieces move over the panel and the graphics behind it so that the player looking at the mirror appears to be seeing balls rolling down the mirror, for example.

Many other objects could also move across the transparent panel in different ways. If the slant of the panel is reversed, objects (perhaps balloons) would appear to be rising, when viewed in the mirror. Or if the slant is to the side, perhaps the sliding objects might appear to be a horse race across the mirror screen.

Controls on the front of the box enable the player to manipulate objects above the transparent panel. Thus, for example, he might manipulate either balls rolling under gravity and over the transparent panel as if he were playing a pinball machine or a basket to catch the balls at the far edge of the panel. To make another game, it might be necessary to do no more than to change the graphics and, perhaps the playing pieces. For example, instead of playing balls rolling downhill in a pinball machine, the inclination of the transparent panel may be reversed so that the balls rolling down the panel appear to be balloons raising into the sky.

A preferred embodiment of the invention is shown in the attached drawing in which.

Figure 6:
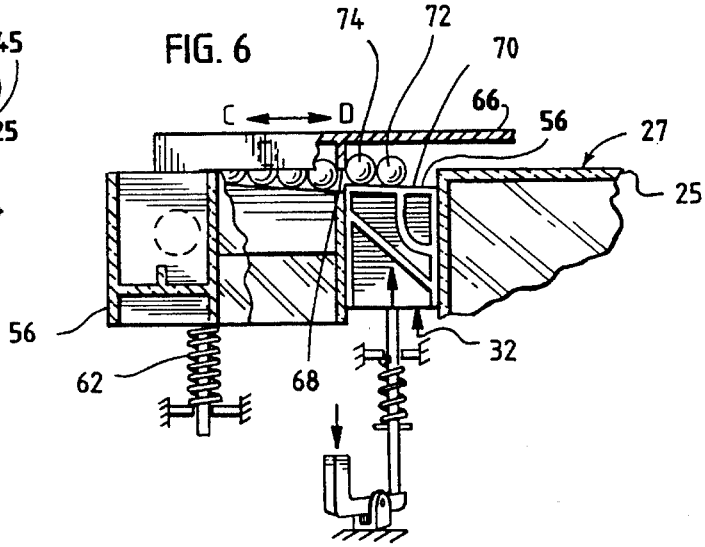

FIG. 6 schematically shows a mechanism for selecting the number of balls that might be released simultaneously.

Figure 2:
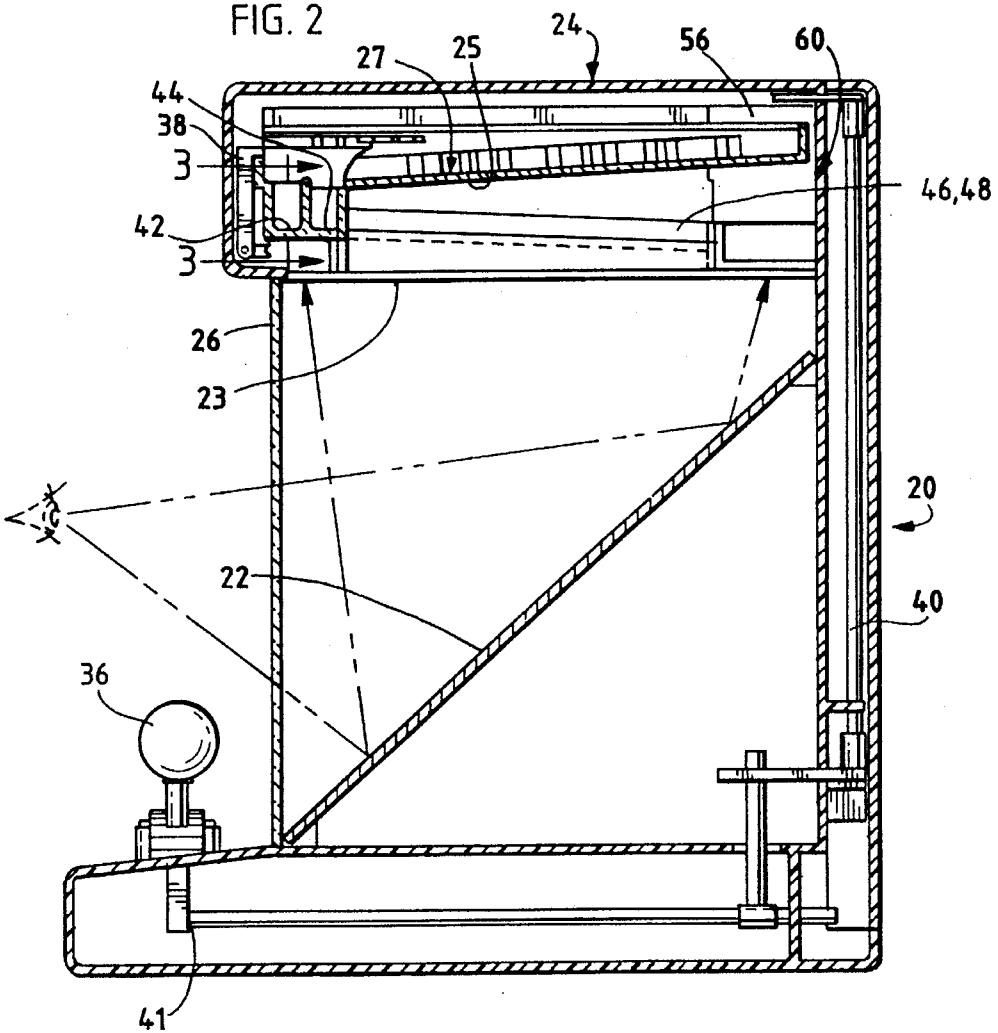
FIG. 2 is a cross sectional view taken along line 2—2 of FIG. 1.
Figure 1:
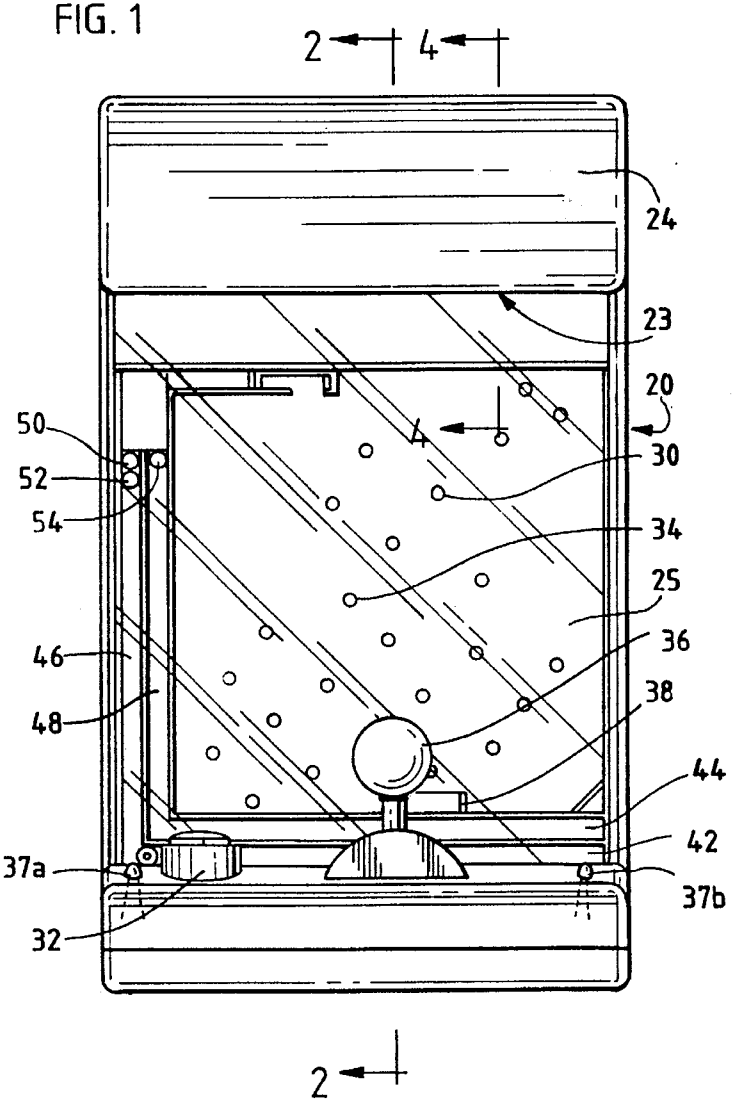
FIG. 1 is a schematic elevation plan view showing an example of an inventive game featuring a pinball game.

In FIGS. 1, 2 a box 20 has an open front with a mirror 22 set at an angle which reflects an image of the underside surface 23 of the top 24 of the box. Of course, the player who is watching the mirror 22 is only looking at a reflection of what is going on above a transparent panel 25 above the underside 23 of the top 24. The transparent panel 25 is set at an angle so that an object will roll or slide down the top side 27 of an inclined plane under the force of gravity.

Thus, the box 20 has an open face 26 on one side through which a person may look to see an image in mirror 22 which is set at an angle that reflects anything above transparent plates 23, 25, in the under side of the box top 24. Background graphics may be provided on the underside of the top panel of box top 24 so that the active objects will appear in mirror 22 to be moving against an appropriate background.

Since the transparent plate 25 is set at an angle, gravity will cause anything resting on its upper surface 27 to roll or slide down in direction E. In this embodiment, a plurality of preferably steel balls roll down in simulation of a pinball machine. In greater detail, a release mechanism (FIG. 4) releases one steel ball 30 each time that a push button 32 (FIG. 1) is pushed on the front of the machine. This ball release means may incorporate an elevator which is raised when push button 32 is pushed. The elevator may carry one or several balls at a time so that one or several balls may roll at a time. The skill level required to play the game increases with the number of balls that roll simultaneously. A plurality of transparent pegs (such as 34) are integrally formed on the top surface of plate 25. As the ball 30 rolls down the inclined plane of plate 25, it is deflected in random directions by bumping into the pegs.

A spring biased joy stick 36 is provided at the bottom of the mirror screen. The joy stick may be moved left or right (Directions A, B). When released, the spring causes the joy stick to return to a central position. As it moves to the left, the joy stick closes electrical contacts which lights lamp 37*a*. When it moved to the right, it closes contacts to light lamp 37*b*. When the joy stick returns to the central position, the lamps fade out over five or six second period.

At the bottom of the plane 25, a basket 38 is slidably mounted to move back and forth in directions A and B (FIG. 1), responsive to a manipulation of a joy stick 36. The basket 38 is connected to the joy stick 36 via a simple mechanical linkage 40 which is behind the mirror 22 and within the box itself. The linkage 40 is mounted on a bearing support point 41 to pivot around point 41 in response to the movement of the joy stick.

Figure 4:
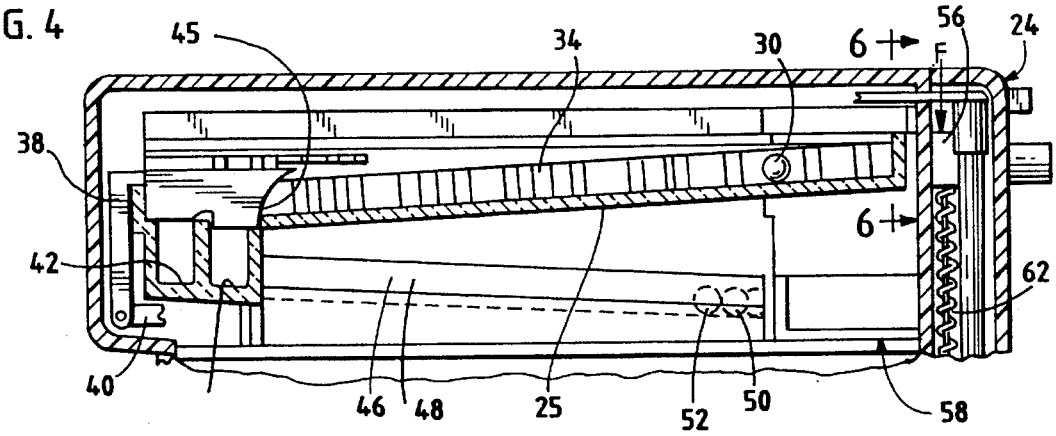
FIG. 4 is a schematic view taken along line 4—4 of FIG. 1.
Figure 5:
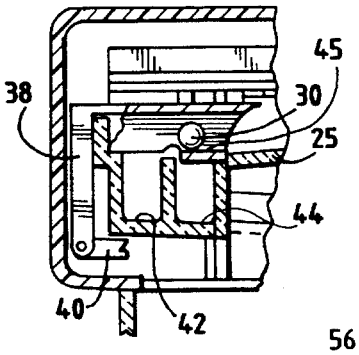
FIG. 5 is a cross section of a basket that is moved to catch balls.

The object of the game is to move the joy stick 36 in a manner which positions basket 38 to catch the ball which is being deflected by the pegs 34 on the panel 25 in order to travel over a random path to the bottom of the panel 25. As seen in FIGS. 4, 5, the bottom of panel 25 terminates in two gutters 42, 44. If the basket 38 is present at the point where the ball encounters the gutters, gutter 44 is covered over by part 45 of the basket. Hence, the ball falls through basket 38 and into gutter 42. On the other hand, if the basket 38 is not present, the ball falls into gutter 44.

Figure 3:
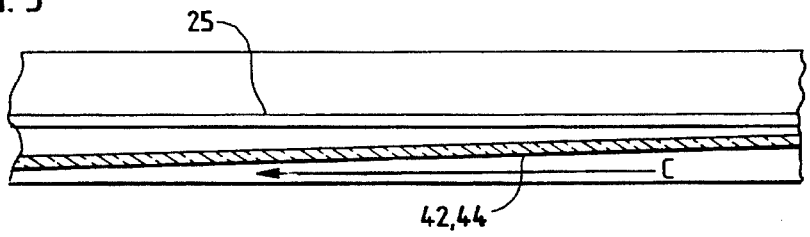
FIG. 3 is a schematic view taken along line 3—3 of FIG. 1.

As best seen in FIG. 3, the two gutters 42, 44 slope downwardly toward an edge of the transparent plate, the left hand edge as viewed in the various Figures. Therefore, any ball falling into either of the gutters 42, 44 rolls to the left (Direction C). From FIG. 1, it is seen that any balls in gutter 42 are deflected into gutter 46, which is one scoring position (ball caught). Any balls in gutter 44 are deflected into gutter 48, the other scoring position (ball not caught).

As seen in FIG. 4, the gutters 46, 48 slope back toward the back of the box. Therefore, any ball that is caught in basket 38 rolls through gutters 42, 46 and is stopped at the end of gutter 46. Any ball that is not captured by basket 38 rolls through gutters 44, 48 and is stopped at the end of gutter 48. As FIG. 1 is drawn, the player has captured two balls 50, 52 in basket 38. The player failed to capture one ball 54 in basket 38.

A spring biased elevator 56 is movable between the lower position 58 shown in FIG. 4, and an upper position 60 seen in FIG. 2. A spring 62 normally raises the elevator 56 to the raised position 60. If the elevator 56 is pushed down, the spring 62 is compressed and balls 50–54 roll into the elevator. When the elevator 56 is released, the tension in compressed spring 62 raises the balls to position 60.

The mechanism of FIG. 6 controls the number of balls that are released in response to each push of the push button 32. In greater detail, as seen in FIG. 6, a slide mechanism 66 is positioned at a convenient location such as near the back of box top 24 and mounted to slide back and forth in directions C, D. Depending upon the position selected, a tab 68 dependent from slide 66 may be set to release a variable number of balls.

Each time that push button 32 is pushed, a lift 70 raises. As here shown, each raising of lift 70 will result in tab 68 fitting between the second and third balls, thus selecting two balls for simultaneous release. Hence, two balls 72, 74 (in this example) are released on to the surface 27 of transparent plate 25. If tab 68 is moved in direction C, one ball could be released. If moved in direction D, three balls could be released. The mechanism for connecting lift 70 to push button 32 may take any suitable form, such as a simple mechanical linkage, as at 40, behind the mirror 32.

In operation, the player presses down (Direction F) and then releases the elevator 56 which raises all balls 50–54 to an elevated position 60 (FIG. 2, 6). Then he pushes button 32 (FIG. 1) and a selected number of balls is released. The balls or ball rolls down surface 27 of the inclined plane 25 (as indicated at 30), randomly bumping into pegs 34 as it rolls. when the ball bounces off the pegs 34, the resulting deflection of the ball causes it to follow a random path down the board 25. The player moves the joy stick 36, and therefore the basket 38, in an effort to have the ball fall into the basket. If successful, the ball is "captured" by basket 38, rolling over part 45 of the basket and being diverted into the scoring path provided by gutters 42, 46 and ending up deposited at 50, 52. If the basket 38 is not there to entrap the ball when it reaches the gutters, it is diverted into a scoring path 44, 48 and is deposited at 54. Finally, the player pushes elevator 36 and plays a new game.

Those who are skilled in the art will readily perceive how to modify the invention. Therefore, the appended claims are to be construed to cover all equivalent structures which fall within the true scope and spirit of the invention.

The claimed invention is:

1. A toy simulation of an arcade game, said toy comprising a box open on at least one side, a mirror set in said box to reflect an image of the underside of a top of said box so that the image is .seen through said open side, the top of said box having a compartment with a transparent bottom panel whereby said mirror reflects an image of the contents of said box that is visible through said bottom panel, and controls on said box for manipulating at least one object in said compartment: so that said object appears to be moving in said image reflected by said mirror.

2. The toy of claim 1 wherein said controls are on a front of said box and under the image reflected by said mirror.

3. The toy of claim 2 and means extending from said controls to said compartment at the top of the box, and means operated by said controls for moving said object within said compartment via said extending means.

4. The toy of claim 3 wherein said extending means leading from said controls to said compartment includes a joy stick and links which are flexibly joined to each other so that said object moves with movement of the joy stick.

5. The toy of claim 4 and graphics in said compartment against which an image of said object appears to be moving when viewed in said mirror.

6. The toy of claim 3 and means for selecting a predetermined number of objects for simultaneous release on to said transparent bottom panel.

7. The toy of claim 3 and means for setting said transparent panel at an angle which controls the direction in which said object appears to move over said mirror.

8. A toy comprising a box which is at least partially closed on at least three sides and open on at least one side, a compartment in one of said closed sides, an inclined transparent panel forming an underside of said compartment which faces an interior of said box, a mirror in said box for reflecting an image of said transparent panel out said open side, a plurality of pegs formed on the upper side of said transparent panel, means for releasing a predetermined number of balls at a time to roll over a randomly variable path across said transparent panel, means for catching a ball at a bottom of said randomly variable path, said catching means reflected by said mirror, and means for directing those of said balls which are caught into another scoring path.

9. The toy of claim 8 wherein said compartment has at least one spring biased elevator means, and means responsive to manipulation of said elevator means for returning said balls from said scoring path to said means for releasing said balls.

10. The toy of claim 9 wherein said scoring paths comprise two gutters on the bottom of said transparent panel, said object diverting caught balls into one of said gutters, and said balls which were not caught running into the other of said gutters.

11. The toy of claim 9 and means associated with said elevator means for making said selection of said predetermined number of balls to be released at a time.

12. The toy of claim 9 and means for lighting laid transparent panel at locations coordinated with the instantaneous position of said object to capture said ball.

13. A toy comprising:

a game compartment with a transparent surface;

at least one object which can be positioned on the transparent surface;

a mirror positioned relative to the surface so that an image of the compartment through the transparent surface is seen in the mirror;

and means for controlling movement of the object relative to the transparent surface, the controlling means being selectively activatable.

14. The toy of claim 13, wherein the controlling means comprise a basket positioned in relation to the transparent surface to receive the object therefrom.

15. The toy of claim 14 comprising a joy stick operatively connected to the basket, wherein the basket is located adjacent an edge of the transparent surface and can be moved along the edge by activating the joy stick.

16. The toy of claim 13, comprising at least one predetermined path, the path having at least one portion connected to the transparent surface, and wherein the controlling means further comprises a basket having portions to direct the object to the predetermined path.

17. The toy of claim 13, further comprising raised portions extending from the transparent surface which the object may contact during movement on the transparent surface.

18. The toy of claim 13, wherein the controlling means further comprise means for loading the object onto the transparent surface.

19. The toy of claim 13, wherein the controlling means further comprise means for inclining the surface to cause the object to move relative to the surface.

20. The toy of claim 13 further comprising a chamber, the transparent surface forming an interior wall of the chamber, and wherein the mirror is positioned at an angle to the transparent surface, the chamber having an opening through which the image on the mirror can be seen.

21. The toy of claim 13, wherein the mirror is positioned relative to the surface to form a reverse image of the compartment when viewed through the opening.

22. The toy of claim 13, wherein the surface forms an inclined plane to cause the object to move in a first direction and the movement of the object is seen in the mirror as movement in a second direction opposite the first direction.

23. The toy of claim 22, wherein the inclined plane is positioned relative to the mirror so that when the object moves over the inclined plane under gravity's influence the corresponding movement seen in the mirror is contrary to gravity.

* * * * *